US008720604B2

(12) United States Patent
Sheppard et al.

(10) Patent No.: US 8,720,604 B2
(45) **Date of Patent: *May 13, 2014**

(54) METHOD AND SYSTEM FOR STEERING A DIRECTIONAL DRILLING SYSTEM

(75) Inventors: Michael Charles Sheppard, Hadstock (GB); Ashley Bernard Johnson, Milton (GB); Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 568 days.

This patent is subject to a terminal disclaimer.

(21) Appl. No.: 12/116,444

(22) Filed: May 7, 2008

(65) Prior Publication Data

US 2009/0044981 A1 Feb. 19, 2009

Related U.S. Application Data

(63) Continuation-in-part of application No. 11/839,381, filed on Aug. 15, 2007.

(51) Int. Cl.

| | |
|---|---|
| ***E21B 7/04*** | (2006.01) |
| ***E21B 44/00*** | (2006.01) |
| ***E21B 10/32*** | (2006.01) |
| ***E21B 10/00*** | (2006.01) |

(52) U.S. Cl.

USPC ..... 175/61; 175/24; 175/56; 175/263; 175/266; 175/285

(58) Field of Classification Search

USPC ..... 175/263, 285, 73, 24, 55, 61, 266

See application file for complete search history.

(56) References Cited

U.S. PATENT DOCUMENTS

| | | | |
|---|---|---|---|
| 1,156,147 | A | 10/1915 | Karns |
| 1,638,337 | A | 8/1927 | Hutton |
| 1,667,155 | A | 4/1928 | Higdon |
| 2,010,789 | A | 8/1935 | Roesel |
| 2,016,042 | A | 10/1935 | Lewis |

(Continued)

FOREIGN PATENT DOCUMENTS

| | | | |
|---|---|---|---|
| BE | 1012545 | A3 | 12/2000 |
| EP | 0530045 | A1 | 3/1993 |

(Continued)

OTHER PUBLICATIONS

Dictionary definition of "geostationary" accessed Feb. 24, 2012: p. 1, <http://www.thefreedictionary.com/p/geostationary>.

*Primary Examiner* — James Sayre

(57) ABSTRACT

A drill bit direction system and method is disclosed that modifies or biases the stochastic movement of the drill bit to change a drilling direction of a drilling system. The direction of the drill bit is monitored to determine if the direction happens to align in some way with a preferred direction. If the direction isn't close enough to a preferred or desired direction, stochastic motion of the drill bit in the borehole may be controlled and/or motion of the drill bit under a side force acting on the drill bit to direct the drilling may be focused or biased to modify the direction of drilling closer to the preferred direction. Any of a number of stochastic motion control mechanisms or biasing mechanisms can be used. Some embodiments can resort to conventional steering mechanisms to supplement the stochastic motion control or side force biasing mechanisms.

18 Claims, 4 Drawing Sheets

(56) References Cited

U.S. PATENT DOCUMENTS

| | | | | | |
|---|---|---|---|---|---|
| 2,238,377 | A | | 4/1941 | Strang | |
| 2,670,046 | A | | 2/1954 | Kinzbach | |
| 3,154,156 | A | * | 10/1964 | Cleary et al. | 175/76 |
| 3,224,513 | A | | 12/1965 | Weeden, Jr. | |
| 3,285,349 | A | | 11/1966 | Brandon | |
| 4,190,123 | A | | 2/1980 | Roddy | |
| 4,211,292 | A | | 7/1980 | Evans | |
| 4,319,649 | A | * | 3/1982 | Jeter | 175/73 |
| 4,690,229 | A | | 9/1987 | Raney | |
| 4,739,843 | A | | 4/1988 | Burton | |
| 4,775,017 | A | | 10/1988 | Forrest et al. | |
| 4,807,708 | A | | 2/1989 | Forrest et al. | |
| 4,842,083 | A | | 6/1989 | Raney | |
| 4,856,601 | A | | 8/1989 | Raney | |
| 5,010,789 | A | | 4/1991 | Brett et al. | |
| 5,042,596 | A | | 8/1991 | Brett et al. | |
| 5,090,492 | A | | 2/1992 | Keith | |
| 5,113,953 | A | | 5/1992 | Noble | |
| 5,159,577 | A | | 10/1992 | Twist | |
| 5,163,524 | A | | 11/1992 | Newton, Jr. et al. | |
| 5,213,168 | A | | 5/1993 | Warren et al. | |
| 5,265,682 | A | * | 11/1993 | Russell et al. | 175/45 |
| 5,339,910 | A | | 8/1994 | Mueller | |
| 5,341,886 | A | | 8/1994 | Patton | |
| 5,343,964 | A | | 9/1994 | Leroy | |
| 5,361,859 | A | | 11/1994 | Tibbitts | |
| 5,423,389 | A | | 6/1995 | Warren et al. | |
| 5,490,569 | A | | 2/1996 | Brotherton et al. | |
| 5,520,255 | A | | 5/1996 | Barr et al. | |
| 5,553,678 | A | * | 9/1996 | Barr et al. | 175/73 |
| 5,553,679 | A | | 9/1996 | Thorp | |
| 5,560,440 | A | | 10/1996 | Tibbitts | |
| 5,582,259 | A | | 12/1996 | Barr | |
| 5,603,385 | A | | 2/1997 | Colebrook | |
| 5,641,421 | A | | 6/1997 | Manov et al. | |
| 5,649,604 | A | | 7/1997 | Fuller et al. | |
| 5,651,421 | A | | 7/1997 | Newton et al. | |
| 5,673,763 | A | | 10/1997 | Thorp | |
| 5,685,379 | A | | 11/1997 | Barr et al. | |
| 5,695,015 | A | | 12/1997 | Barr et al. | |
| 5,697,461 | A | | 12/1997 | Newton et al. | |
| 5,706,905 | A | | 1/1998 | Barr | |
| 5,778,992 | A | | 7/1998 | Fuller | |
| 5,803,185 | A | | 9/1998 | Barr et al. | |
| 5,803,196 | A | | 9/1998 | Fielder | |
| 5,836,406 | A | | 11/1998 | Schuh | |
| 5,971,085 | A | | 10/1999 | Colebrook | |
| 5,979,577 | A | | 11/1999 | Fielder | |
| 6,089,332 | A | | 7/2000 | Barr et al. | |
| 6,092,610 | A | | 7/2000 | Kosmala et al. | |
| 6,142,250 | A | | 11/2000 | Griffin et al. | |
| 6,158,529 | A | | 12/2000 | Dorel | |
| 6,244,361 | B1 | | 6/2001 | Comeau et al. | |
| 6,257,356 | B1 | | 7/2001 | Wassell | |
| 6,290,007 | B2 | | 9/2001 | Beuershausen et al. | |
| 6,360,831 | B1 | | 3/2002 | Akesson et al. | |
| 6,364,034 | B1 | | 4/2002 | Schoeffler | |
| 6,394,193 | B1 | | 5/2002 | Askew | |
| 6,427,792 | B1 | | 8/2002 | Roberts et al. | |
| 6,601,658 | B1 | | 8/2003 | Downton | |
| 6,604,658 | B1 | | 8/2003 | Young et al. | |
| 6,629,476 | B2 | | 10/2003 | Fielder et al. | |
| 6,904,984 | B1 | | 6/2005 | Estes et al. | |
| 6,971,459 | B2 | | 12/2005 | Raney | |
| 7,090,037 | B2 | | 8/2006 | Best | |
| 7,201,237 | B2 | | 4/2007 | Raney | |
| 7,287,604 | B2 | | 10/2007 | Aronstam et al. | |
| 7,306,056 | B2 | * | 12/2007 | Ballantyne et al. | 175/61 |
| 7,308,955 | B2 | | 12/2007 | Barton et al. | |
| 7,757,784 | B2 | | 7/2010 | Fincher et al. | |
| 7,762,356 | B2 | | 7/2010 | Turner et al. | |
| 7,836,975 | B2 | | 11/2010 | Chen et al. | |
| 7,845,430 | B2 | | 12/2010 | Johnson et al. | |
| 7,971,661 | B2 | | 7/2011 | Johnson et al. | |
| 7,971,662 | B2 | | 7/2011 | Beuershausen | |
| 8,066,085 | B2 | | 11/2011 | Johnson et al. | |
| 8,087,479 | B2 | | 1/2012 | Kulkarni et al. | |
| 2001/0052428 | A1 | | 12/2001 | Larronde et al. | |
| 2002/0011359 | A1 | | 1/2002 | Webb et al. | |
| 2002/0020565 | A1 | | 2/2002 | Hart et al. | |
| 2002/0053470 | A1 | | 5/2002 | Noe et al. | |
| 2002/0088649 | A1 | | 7/2002 | Morris, Sr. et al. | |
| 2003/0056991 | A1 | | 3/2003 | Hahn et al. | |
| 2004/0099444 | A1 | | 5/2004 | Chen et al. | |
| 2004/0216921 | A1 | | 11/2004 | Krueger | |
| 2005/0056463 | A1 | * | 3/2005 | Aronstam et al. | 175/61 |
| 2005/0236187 | A1 | | 10/2005 | Chen et al. | |
| 2005/0269082 | A1 | | 12/2005 | Baron et al. | |
| 2006/0157277 | A1 | | 7/2006 | Bittar et al. | |
| 2006/0196697 | A1 | | 9/2006 | Raney | |
| 2006/0237234 | A1 | | 10/2006 | Dennis et al. | |
| 2006/0249287 | A1 | | 11/2006 | Downton et al. | |
| 2007/0007000 | A1 | | 1/2007 | Dewey et al. | |
| 2007/0205022 | A1 | | 9/2007 | Treviranus et al. | |
| 2007/0272445 | A1 | | 11/2007 | Cariveau et al. | |
| 2008/0000693 | A1 | | 1/2008 | Hutton | |
| 2008/0115974 | A1 | | 5/2008 | Johnson et al. | |
| 2009/0044977 | A1 | | 2/2009 | Johnson et al. | |
| 2009/0044979 | A1 | | 2/2009 | Johnson et al. | |
| 2009/0044980 | A1 | | 2/2009 | Sheppard et al. | |
| 2009/0065262 | A1 | | 3/2009 | Downton et al. | |
| 2009/0188720 | A1 | | 7/2009 | Johnson et al. | |
| 2009/0194334 | A1 | | 8/2009 | Johnson et al. | |
| 2010/0038141 | A1 | | 2/2010 | Johnson et al. | |
| 2012/0018224 | A1 | | 1/2012 | Johnson et al. | |
| 2012/0090897 | A1 | | 4/2012 | Johnson et al. | |

FOREIGN PATENT DOCUMENTS

| | | | |
|---|---|---|---|
| EP | 0707131 | A2 | 4/1996 |
| EP | 0707131 | A3 | 10/1996 |
| EP | 1227214 | A2 | 7/2002 |
| EP | 1227214 | A3 | 3/2003 |
| GB | 2257182 | A | 1/1993 |
| GB | 2285651 | A | 7/1995 |
| GB | 2304759 | A | 3/1997 |
| GB | 2343470 | A | 5/2000 |
| GB | 2355744 | A | 5/2001 |
| GB | 2367626 | A | 4/2002 |
| GB | 2408526 | A | 8/2006 |
| GB | 2423102 | A | 8/2006 |
| GB | 2423546 | A | 8/2006 |
| GB | 2425790 | A | 11/2006 |
| GB | 2439661 | A | 1/2008 |
| RU | 2006560 | | 1/1994 |
| RU | 2029047 | | 2/1995 |
| RU | 2072419 | | 1/1997 |
| RU | 2100559 | | 12/1997 |
| RU | 2239042 | | 10/2004 |
| RU | 2006100565 | | 7/2007 |
| WO | 9619635 | A1 | 6/1996 |
| WO | 9747848 | A1 | 12/1997 |
| WO | 9815710 | A1 | 4/1998 |
| WO | 9928587 | A1 | 6/1999 |
| WO | 0121927 | A2 | 3/2001 |
| WO | 0236924 | A2 | 5/2002 |
| WO | 03/004824 | A1 | 1/2003 |
| WO | 03052237 | A1 | 6/2003 |
| WO | 03/097989 | A1 | 11/2003 |
| WO | 2004104360 | A2 | 12/2004 |
| WO | 2004113664 | A1 | 12/2004 |
| WO | 200612186 | A1 | 2/2006 |
| WO | 2007012858 | A1 | 2/2007 |
| WO | 2007036722 | | 4/2007 |

* cited by examiner

METHOD AND SYSTEM FOR STEERING A DIRECTIONAL DRILLING SYSTEM

This application claims the benefit of and is a continuation-in-part of co-pending U.S. application Ser. No. 11/839,381 filed on Aug. 15, 2007, entitled SYSTEM AND METHOD FOR CONTROLLING A DRILLING SYSTEM FOR DRILLING A BOREHOLE IN AN EARTH FORMATION, which is hereby expressly incorporated by reference in its entirety for all purposes.

This application is related to the U.S. patent application Ser. No. 12/116,380, filed May 7, 2008, on the same date as the present application, entitled "STOCHASTIC BIT NOISE CONTROL", now U.S. Pat. No. 8,066,085 issued Nov. 29, 2011, which is incorporated by reference in its entirety for all purposes.

This application is related to U.S. patent application Ser. No. 12/116,390, filed May 7, 2008, on the same date as the present application, entitled "DRILL BIT GAUGE PAD CONTROL", which is incorporated by reference in its entirety for all purposes.

This application is related to U.S. patent application Ser. No. 12/116,408, filed May 7, 2008, on the same date as the present application, entitled "SYSTEM AND METHOD FOR DIRECTIONALLY DRILLING A BOREHOLE WITH A ROTARY DRILLING SYSTEM", which is incorporated by reference in its entirety for all purposes.

BACKGROUND

This disclosure relates in general to drilling a borehole and, but not by way of limitation, to controlling direction of drilling for the borehole.

In many industries, it is often desirable to directionally drill a borehole through an earth formation or core a hole in sub-surface formations in order that the borehole and/or coring may circumvent and/or pass through deposits and/or reservoirs in the formation to reach a predefined objective in the formation and/or the like. When drilling or coring holes in sub-surface formations, it is sometimes desirable to be able to vary and control the direction of drilling, for example to direct the borehole towards a desired target, or control the direction horizontally within an area containing hydrocarbons once the target has been reached. It may also be desirable to correct for deviations from the desired direction when drilling a straight hole, or to control the direction of the hole to avoid obstacles.

In the hydrocarbon industry for example, a borehole may be drilled so as to intercept a particular subterranean-formation at a particular location. In some drilling processes, to drill the desired borehole, a drilling trajectory through the earth formation may be pre-planned and the drilling system may be controlled to conform to the trajectory. In other processes, or in combination with the previous process, an objective for the borehole may be determined and the progress of the borehole being drilled in the earth formation may be monitored during the drilling process and steps may be taken to ensure the borehole attains the target objective. Furthermore, operation of the drill system may be controlled to provide for economic drilling, which may comprise drilling so as to bore through the earth formation as quickly as possible, drilling so as to reduce bit wear, drilling so as to achieve optimal drilling through the earth formation and optimal bit wear and/or the like.

One aspect of drilling is called "directional drilling." Directional drilling is the intentional deviation of the borehole/wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

The monitoring process for directional drilling of the borehole may include determining the location of the drill bit in the earth formation, determining an orientation of the drill bit in the earth formation, determining a weight-on-bit of the drilling system, determining a speed of drilling through the earth formation, determining properties of the earth formation being drilled, determining properties of a subterranean formation surrounding the drill bit, looking forward to ascertain properties of formations ahead of the drill bit, seismic analysis of the earth formation, determining properties of reservoirs etc. proximal to the drill bit, measuring pressure, temperature and/or the like in the borehole and/or surrounding the borehole and/or the like. In any process for directional drilling of a borehole, whether following a pre-planned trajectory, monitoring the drilling process and/or the drilling conditions and/or the like, it is necessary to be able to steer the drilling system.

Forces which act on the drill bit during a drilling operation include gravity, torque developed by the bit, the end load applied to the bit, and the bending moment from the drill assembly. These forces together with the type of strata being drilled and the inclination of the strata to the bore hole may create a complex interactive system of forces during the drilling process.

The drilling system may comprise a "rotary drilling" system in which a downhole assembly, including a drill bit, is connected to a drill-string that may be driven/rotated from the drilling platform. In a rotary drilling system directional drilling of the borehole may be provided by varying factors such as weight-on-bit, the rotation speed, etc.

With regards to rotary drilling, known methods of directional drilling include the use of a rotary steerable system (RSS). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottomhole assembly ("BHA") in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer.

Pointing the bit may comprise using a downhole motor to rotate the drill bit, the motor and drill bit being mounted upon a drill string that includes an angled bend. In such a system, the drill bit may be coupled to the motor by a hinge-type or tilted mechanism/joint, a bent sub or the like, wherein the drill bit may be inclined relative to the motor. When variation of the direction of drilling is required, the rotation of the drill-string may be stopped and the bit may be positioned in the borehole, using the downhole motor, in the required direction and rotation of the drill bit may start the drilling in the desired direction. In such an arrangement, the direction of drilling is dependent upon the angular position of the drill string.

In its idealized form, in a pointing the bit system, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

Push the bit systems and methods make use of application of force against the borehole wall to bend the drill-string and/or force the drill bit to drill in a preferred direction. In a push-the-bit rotary steerable system, the requisite non-collinear condition is achieved by causing a mechanism to apply a force or create displacement in a direction that is preferentially orientated with respect to the direction of hole propagation. There are many ways in which this may be achieved, including non-rotating (with respect to the hole), displacement based approaches and eccentric actuators that apply force to the drill bit in the desired steering direction. Again, steering is achieved by creating non co-linearity between the drill bit and at least two other touch points. In its idealized form the drill bit is required to cut sideways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Known forms of RSS are provided with a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geostationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction.

The force generated by the actuators/pads is balanced by the force to bend the bottomhole assembly, and the force is reacted through the actuators/pads on the opposite side of the bottomhole assembly and the reaction force acts on the cutters of the drill bit, thus steering the hole. In some situations, the force from the pads/actuators may be large enough to erode the formation where the system is applied.

For example, the Schlumberger™ Powerdrive™ system uses three pads arranged around a section of the bottomhole assembly to be synchronously deployed from the bottomhole assembly to push the bit in a direction and steer the borehole being drilled. In the system, the pads are mounted close, in a range of 1-4 ft behind the bit and are powered/actuated by a stream of mud taken from the circulation fluid. In other systems, the weight-on-bit provided by the drilling system or a wedge or the like may be used to orient the drilling system in the borehole.

While system and methods for applying a force against the borehole wall and using reaction forces to push the drill bit in a certain direction or displacement of the bit to drill in a desired direction may be used with drilling systems including a rotary drilling system, the systems and methods may have disadvantages. For example such systems and methods may require application of large forces on the borehole wall to bend the drill-string and/or orient the drill bit in the borehole; such forces may be of the order of 5 kN or more, that may require large/complicated downhole motors or the like to be generated. Additionally, many systems and methods may use repeatedly thrusting of pads/actuator outwards into the borehole wall as the bottomhole assembly rotates to generate the reaction forces to push the drill bit, which may require complex/expensive/high maintenance synchronizing systems, complex control systems and/or the like.

The drill bit is known to "dance" or clatter around in a borehole in an unpredictable or even random manner. This stochastic movement is generally non-deterministic in that a current state does not fully determine its next state. Point-the-bit and push-the-bit techniques are used to force a drill bit into a particular direction and overcome the tendency for the drill bit to clatter. These techniques ignore the stochastic dance a drill bit is likely to make in the absence of directed force.

SUMMARY

In an embodiment, the present disclosure provides for steering a direction system to directionally drill a borehole. In one embodiment, steering of the directional drilling system is provided by controlling stochastic motion of a bottomhole assembly, which assembly includes a drill bit, of the directional drilling system in the borehole and/or controlling reactionary forces between the bottomhole assembly and an inner-wall/sidewall of the borehole when a side force is being applied to the bottomhole assembly/drill bit. These steering methods/systems may provide for changing direction of the wellbore system with less effort/less complex machinery/less cost than conventional steering mechanisms. In an embodiment, the direction of drilling of the drilling system is monitored and the monitored direction of drilling is processed along with a desired endpoint of the borehole being drilled. The directional drilling system is then controlled to drill the borehole so as to reach the desired endpoint by adjusting the steering provided by controlling the stochastic motion and/or biasing a side force acting on the bottomhole assembly/drill bit. Any number of biasing mechanisms can be used, such as described, for example, in co-pending U.S. patent application Ser. No. 12/116,408, filed May 7, 2008, on the same date as the present application, entitled "SYSTEM AND METHOD FOR DIRECTIONALLY DRILLING A BOREHOLE WITH A ROTARY DRILLING SYSTEM", which is incorporated by reference in its entirety for all purposes. Some embodiments can resort to conventional steering mechanisms to supplement or as an alternative to the biasing mechanism.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It being understood that various changes may be made in the function and arrangement of elements without departing from the spirit and scope as set forth in the appended claims.

Figure 1A:
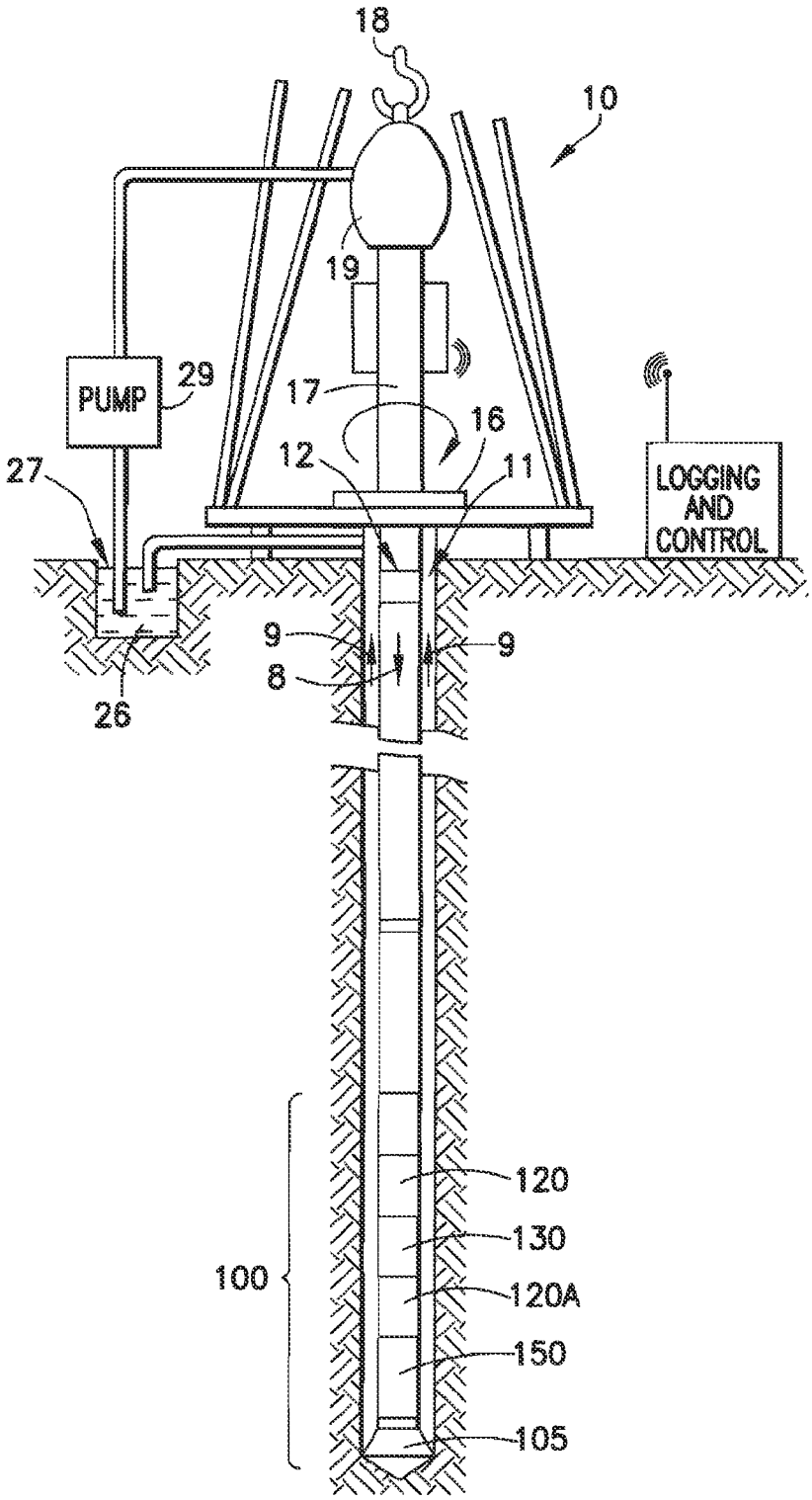
FIG. 1A depicts a wellsite system in which the present invention can be employed.

FIG. 1A illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment a logging-while-drilling (LWD) module 120, a measuring-while-drilling (MWD) module 130, a rotary steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1A) is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Figure 1B:
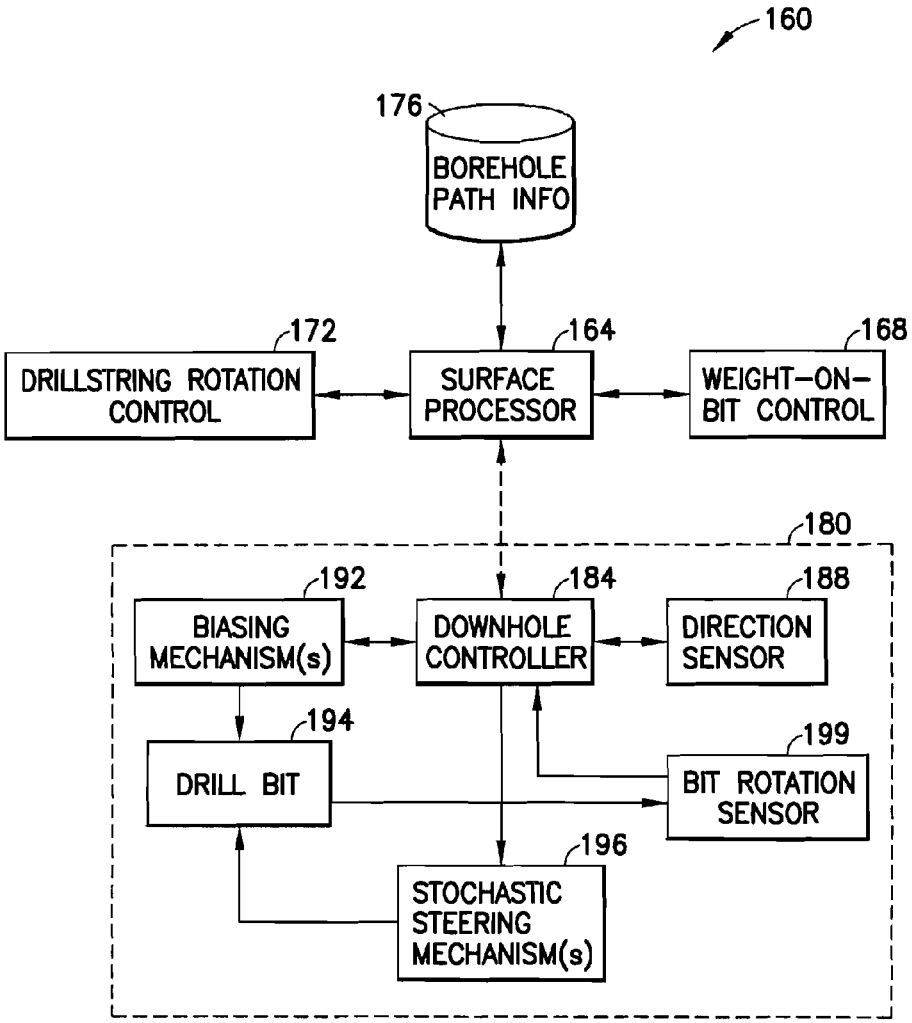
FIG. 1B depicts a block diagram of an embodiment of a drill bit direction system.

Referring first to FIG. 1B, a block diagram of an embodiment of a drill bit direction system 160 is shown. In certain aspects of the present invention, a surface processor 164 is located above ground to manage the drillstring at the surface. The drillstring may be managed at the surface by changing the rate of rotation of the drillstring, changing the weight-on-bit being provided by the drillstring and/or the like. As such, the surface processor 164 may be in communication with and control a drillstring rotation control 172 and/or a weight-on-bit control 168. Often, a person is in control of drilling operations and the surface processor 164 may have a display, graphical user interface or the like to provide information/instructions to the driller.

The surface processor 164 may manage/guide the direction of drilling in the earth formation by controlling surface and/or downhole devices to change one or more drilling parameters, such as weight-on-bit, speed of rotation, application of side force to the bottomhole assembly and/or the like. In other aspects of the present invention, a downhole controller 184 may manage a direction of drilling. A drilling trajectory may be communicated to the downhole controller 184 and the downhole controller 184 may control drilling parameters to control the direction of drilling. The drilling trajectory may be updated by communications sent to the downhole controller 184 during the drilling process. In some aspects, it may be desirable for the downhole controller 184 to manage the direction of drilling because of difficulties in communicating from a downhole location to the surface. Furthermore, the downhole controller 184 may be closer to and/or better able to communicate with downhole devices for changing drilling parameters, such as side force generators, than the surface processor 164. In certain aspects of the present invention, the directional drilling system may comprise both the surface processor 164 and/or the downhole controller 184 and the management of direction of drilling may be shared by the surface processor 164 and/or the downhole controller 184.

In an embodiment of the present invention, a bottomhole assembly 180 of the directional drilling system may be coupled with a stochastic steering mechanism 196 and/or a biasing mechanism 192. The stochastic steering mechanism 196 may be a mechanism that controls the interactions between the bottomhole assembly 180 and/or a drill bit 194 and an inner-wall of the borehole being drilled by the directional drilling system. Interactions may occur between an outer-surface of the bottomhole assembly 180 and/or the drill bit 194 and/or gauge pads (not shown) on the bottomhole assembly 180 and/or the drill bit 194 during the drilling process as a result of stochastic/radial motion of the bottomhole assembly 180 and/or the drill bit 194 in the borehole. The interactions between the bottomhole assembly 180 and/or the drill bit 194 and the inner-wall may comprise impacts between the bottomhole assembly 180 and/or the drill bit 194 and the inner-wall and/or continuous interactions between the bottomhole assembly 180 and/or the drill bit 194 and the inner-wall with instances of increased or decreased interaction forces between the bottomhole assembly 180 and/or the drill bit 194 and the inner-wall, i.e., the bottomhole assembly 180 and/or the drill bit 194 may essentially be in continuous contact with the inner-wall, but radial motion of the bottomhole assembly 180 and/or the drill bit 194 during a drilling process may provide for generating stochastic contact forces between the bottomhole assembly 180 and/or the drill bit 194 and the inner-wall. As provided in U.S. application Ser. No. 11/839,381 filed on Aug. 15, 2007, entitled SYSTEM AND METHOD FOR CONTROLLING A DRILLING SYSTEM FOR DRILLING A BOREHOLE IN AN EARTH FORMATION, the impacts and/or the stochastic contact forces may be controlled, focussed and/or biased to provide for directing the drill bit 194 to directionally drill the borehole.

In an embodiment of the present invention, the bottomhole assembly 180 of the directional drilling system may be coupled with a biasing mechanism 192. The biasing mechanism 192 may comprise a system, such as described in U.S. patent application Ser. No. 12/116,408, filed on the same date as the present application, entitled "SYSTEM AND METHOD FOR DIRECTIONALLY DRILLING A BOREHOLE WITH A ROTARY DRILLING SYSTEM", that may provide for biasing/focusing a side force acting on the bottomhole assembly 180 and/or the drill bit 194.

Information may be communicated from the surface processor 164 and/or the downhole controller 184 to the bottomhole assembly 180, the information may include a desired orientation or direction to achieve for the drill bit 194, selection of various biasing and steering mechanisms 192, 196 to use to achieve drilling in a desired direction, and/or the like. In certain aspects, the direction may be defined relative to any fixed point, such as the earth. The information may additionally provide control information for the bottomhole assembly 180, the biasing mechanism 192 and/or the stochastic steering mechanism 196.

The bottomhole assembly 180 may comprise the downhole controller 184, an orientation or direction sensor 188, a bit rotation sensor 199, one or more biasing mechanism 192, and one or more stochastic steering mechanism 196. A typical bottomhole assembly ("BHA") may have more control systems, which are not shown in FIG. 1B. Information may be communicated to the bottomhole assembly 180 from the surface processor 164 and/or the downhole controller 184 to indicate a preferred drilling direction. In certain embodiments of the present invention, the biasing and steering mechanisms 192, 196 may be controlled by the surface processor 164 and/or the downhole controller 184 to steer the drilling system. In certain aspects, the downhole controller 164 may provide for controlling real-time operation of the biasing and steering mechanisms 192, 196 with information gathered from the direction and bit rotation sensors 188, 199.

Merely by way of example, the surface processor 164 and/or the downhole controller 184 may be in communication with drilling sensors, such as sensors measuring weight-on-bit, torque, speed of rotation of the drillstring, bit wear, borehole pressure, borehole temperature and/or the like. Additionally, sensors measuring characteristics of the formation being drilled such as pore pressure, formation-type and or the like may also communicate with the surface processor 164 and/or the downhole controller 184. The surface processor 164 and/or the downhole controller 184 may process the sensed information and a desired endpoint for the wellbore and control the bottomhole assembly 180 to provide directional drilling of the borehole to achieve the desired endpoint. The desired endpoint may comprise a trajectory that passes through a region of formation containing a hydrocarbon, may be a general endpoint that provides such a trajectory, may be a more specific endpoint designed to arrive at a specific location in the formation, may be a temporary endpoint that may be superseded by a further endpoint after it is achieved and or the like.

In certain aspects, a drilling trajectory to achieve a desired directional borehole may be communicated to the surface processor 164 and/or the downhole controller 184 and the surface processor 164 and/or the downhole controller 184 may control the bottomhole assembly 180 to maintain the drilling trajectory. However, this may provide for a meandering borehole, may not take into account preferable drilling conditions outside of the drilling trajectory and may not allow for a time lag that may be inherent in changing the direction of drilling using the and/or the steering mechanisms 192, 196. For example, the stochastic steering mechanism 196 provides for controlling stochastic motion of the drill bit 194 to direct the drilling direction of the drilling system and biasing mechanism 192 provides for biasing/focusing a side force to direct the direction of drilling of the drilling system both of which may involve gradual changes in borehole direction. As such, instead of defined trajectories, the surface processor 164 and/or the downhole controller 184 may process a desired endpoint for the borehole, the drilling measurements, the formation measurements, the present direction of drilling, the rate of effect on changing drilling direction of the biasing and/or the stochastic steering mechanisms 192, 196 and/or the like to determine how to control the biasing and/or the stochastic steering mechanisms 192, 196 to steer the drilling system to achieve the desired endpoint. In some aspects, a PeriScope™ system, EcoScope™ system, StethoScope™ system and/or the like may be used to determine how to direct the drilling of the borehole.

The PeriScope™ system maps bed boundaries and clearly indicates the best steering direction, and the deep measurement range gives you an early warning that steering adjustments are required to avoid water or drilling hazards or to avoid exiting the reservoir target. The EcoScope™ system may act as a logging while drilling tool that may use resistivity, neutron porosity, and azimuthal gamma ray and density to evaluate a formation and its properties during the drilling process. Drilling optimization measurements may include Annular Pressure While Drilling, caliper borehole measurement, and shock. The StethoScope™ system may improve geosteering and geostopping decisions with real-time formation pressure measurements. Quick decisions may be based on results from the StethoScope™ system to eliminate time wasted drilling pressure-depleted formations and can preserve virgin pressure zones scheduled for sidetrack development or completion.

Measurement-While-Drilling (MWD) surveying for directional and horizontal drilling processes is performed to provide the orientation and the position of the BHA [Conti, 1999]. Azimuth, the inclination and the tool face angles determine the orientation of the BHA, while latitude, longitude and altitude determine the position of the BHA. The altitude directly determines the true vertical depth of the BHA. State of the art MWD surveying techniques are based on magnetic surveying which incorporates three-axis magnetometers and three-axis accelerometers arranged in three-mutually orthogonal directions. The three-axis accelerometers monitor the Earth gravity field to provide the inclination and the tool face angles. This information is combined with the magnetometer measurements of the Earth magnetic field to provide the azimuth.

For this purpose, two different approaches are currently used, on the one hand rotary steering systems wherein the rotation of the drill bit is deflected into the desired direction while the entire drill string is rotated from surface, or mud motors in combination with bent subs or housings, wherein only the lower end of the drill string is rotated by the action of the mud motor. The surveying system can include a measurement-while-drilling (MWD) system and/or a logging-while drilling (LWD) system for determining orientation parameters in the course of the drilling operation and/or measuring parameters of the formation or in the borehole. Moreover, in certain aspects, especially in shallow horizontal-type wells, the bottomhole assembly and/or the drill bit may be fitted with a beacon or the like emitting electromagnetic radiation or vibrations that may pass through the earth formation being drilled and a receiver(s) may be used at the surface to receive the transmitted signals and provide for determining the location of the bottomhole assembly and or the direction of drilling.

Drilling data, which may include direction data, steering/biasing data, logging-while-drilling data, forward looking boundary identification data and/or the like, may be communicated to the downhole controller 184 and/or from the BHA 180 back to the surface processor 164 at the surface. The direction of the drill bit may be periodically communicated to the surface processor 164 along with data regarding the use of various biasing and steering mechanisms 192, 196. A borehole path information database 176 may store the information gathered downhole to know how the borehole navigates through the formation. The borehole path information database 176 may be located at surface or downhole. The surface processor 164 and/or the downhole controller 184 may recalculate the best orientation or direction to use for the drill bit 194 and communicate that to the BHA 180 to override any prior instructions. Additionally, the effectiveness of the various biasing and steering mechanisms 192, 196 can be analyzed with other information gathered on the formation to provide guidance downhole on how to best use the available biasing and steering mechanisms 192, 196 to achieve the geometry of the borehole desired for a particular drill site.

Merely by way of example, my monitoring changes in the formation being drilled, boundary conditions, drilling properties and/or the like, settings for the biasing and/or the stochastic steering mechanisms 192, 196 may be determined to provide for steering the drilling system to drill the borehole to reach a desired endpoint. As previously noted, while the biasing and/or the stochastic steering mechanisms 192, 196 of the present invention may require less downhole equipment, less complicated downhole equipment, less downhole force generation and/or the like, the systems may require a temporal lag to provide the desired steering of the drilling system and the surface processor 164 and/or the downhole controller 184 may calculate this temporal lag into the processing of the setting for the biasing and/or the stochastic steering mechanisms 192, 196 and/or the trajectory to reach the desired endpoint. Further, logging-while-drilling measurements may alter the desired endpoint and this change may be processed into the steering of the drilling system by the biasing and/or the stochastic steering mechanisms 192, 196.

The direction sensor 188 can determine the current direction of the drill bit 194 and/or the bottomhole assembly 180 with respect to a particular frame of reference in three dimensions (i.e., relative to the earth or some other fixed point). Various techniques can be used to determine the current direction, for example, an inertially- or roll-stabilized platform with gyros can be compared to references on the drill bit 194, accelerometers may be used to track direction and/or magnetometers may measure direction relative to the earth's magnetic field. Measurements may be noisy and a filter may be used to average out the noise from measurements. In other aspects of the present invention, a microseismic system may be used to track location of the drill bit 194 and/or the bottomhole assembly 180 by measuring vibrational data in the earth formation.

The bit rotation sensor 199 allows monitoring of the phase of rotation for the drill bit 194. The downhole controller 184 may use the sensor information to allow for synchronized control of the biasing and/or the stochastic steering mechanisms 192, 196. With knowledge of the phase, the biasing and/or the stochastic steering may be performed every rotation cycle or any integer fraction of the cycles (e.g., every other rotation, every third rotation, every fourth rotation, every tenth rotation, etc.). Other embodiments do not use a bit rotation sensor 199 or synchronized manipulation of the biasing mechanism(s) 192.

There are various stochastic steering mechanisms 196 that persistently enforce drill bit movement. The stochastic steering mechanism 196 intentionally takes advantage of the stochastic movement of the drill bit 194 that naturally occurs. A given site may use one or more of these stochastic steering mechanism 196 to create a borehole that changes direction as desired through the formation. Other embodiments may forgo stochastic steering mechanism 196 completely by reliance on biasing mechanisms 192 for directional drilling.

The downhole controller 184 may use the information sent from the surface processor 164 along with the direction and bit rotation sensors 188, 199 to actively manage the use of biasing and steering mechanisms 192, 196. The desired direction of the drill bit along with guidelines for using various biasing and steering mechanisms 192, 196 may be communicated from the surface processor 164. The downhole controller 184 may use fuzzy logic, neural algorithms, expert system algorithms to decide how and when to influence the drill bit direction in various embodiments. Generally, the speed of communication between the BHA 180 and the surface processor 164 does not allow real-time control from the surface in this embodiment, but other embodiments could allow for surface control in real-time. The stochastic direction of the drill bit can be adaptively used in a less rigid manner. For example, if a future turn in the borehole is desired and the drill bit is making the turn prematurely, the turn can be accepted and the future plan revised.

Figure 2:
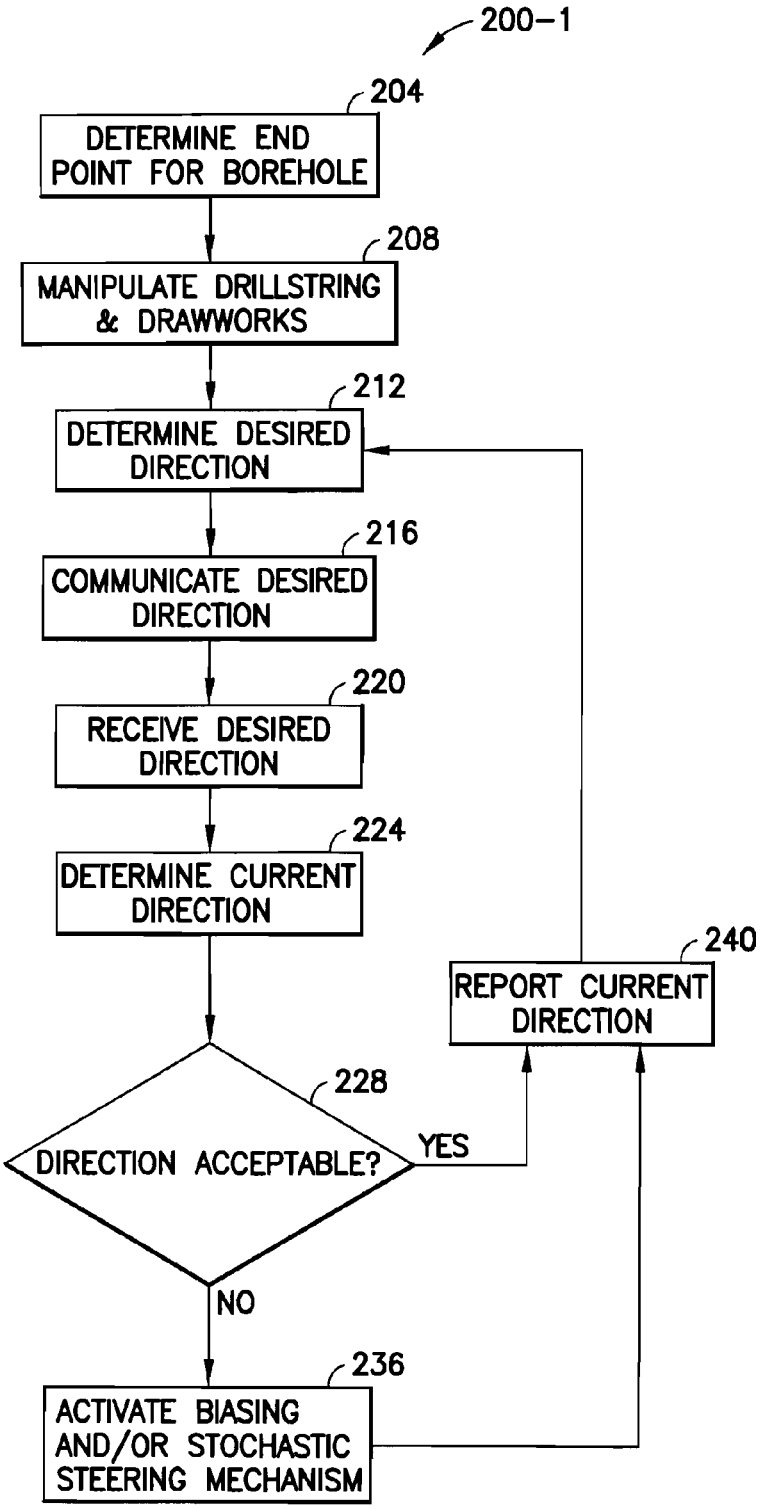
FIG. 2 illustrates a flowchart of one embodiment of a process for controlling drill bit direction.

With reference to FIG. 2, a flowchart of an embodiment of a process 200-1 for controlling drill bit direction is shown. This embodiment uses a biasing and/or stochastic steering mechanism to control the direction of the drill bit. The depicted portion of the process beings in block 204 where an analysis of the formation and an end point is performed to plan the borehole geometry. The surface processor manipulates the drillstring, drawworks and other systems in block 208 to create the borehole according to the plan. A desired direction of the drill bit is determined in block 212 and communicates to the downhole controller in block 216. The desired direction could be a single goal or a range of acceptable directions.

The desired direction along with any biasing selection criteria is received by the downhole controller in block 220. The current pointing of the drill bit is determined by the direction sensor in block 224. It is determined in block 228 if the direction is acceptable based upon the instructions from the surface processor. This embodiment allows some flexibility in the direction and re-determines the plan based upon the movement of the drill bit and the effectiveness of the biasing and/or stochastic steering mechanism. An acceptable direction is one that allows achieving the end point with the drill bit if the plan were revised. A certain plan may have predetermined deviations or ranges of direction that are acceptable, but still avoid parts of the formation that are not desired to pass through.

Where the direction is not acceptable, processing goes from block 228 to block 236 where the biasing and/or stochastic steering mechanism is activated. The biasing and/or stochastic steering mechanism could be activated once or for a period of time. Alternatively, the biasing and/or stochastic steering mechanism could be activated periodically in synchronization with the rotation of the drill bit. The biasing and/or stochastic steering mechanism selects or emphasizes those components of the radial motion of the drill bit or a side force acting on the drill bit that occur in the desired direction(s).

Where the direction is acceptable as determined in block 228, processing continues to block 240. In certain aspects, the biasing and/or stochastic steering mechanism 236 may achieve directional control by holding the direction of drilling in the desired direction(s). Where un-needed because the erratic motion of the drill bit is already in the desired direction(s), the stochastic steering mechanism may not be activated. Similarly, where a side force acting on the drill bit, such as a side force generated by a push the bit system, is already in the desired direction the biasing mechanism may not be activated. In block 240, the current direction is communicated by the downhole controller to the surface processor. Communication may be via regular telemetry methods or via wired drill pipe or the like. After reporting, processing loops back to block 212 for further management of the direction based upon any new instruction from the surface.

Figure 3:
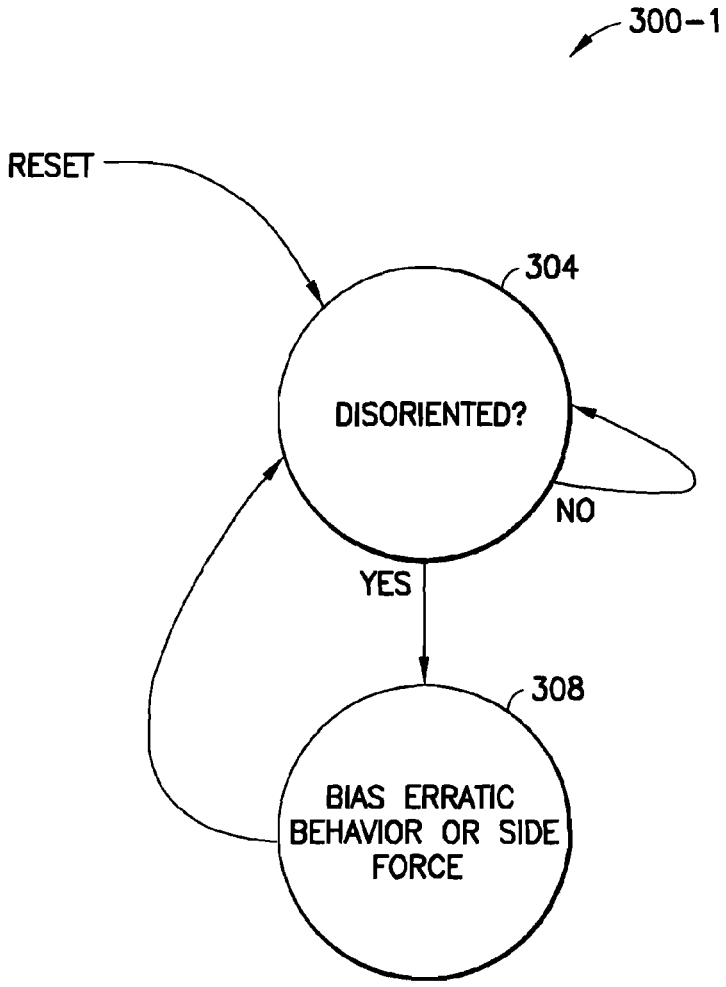
FIG. 3 illustrates a state machine for managing the drill bit direction system.

Referring next to FIG. 3, an embodiment of a state machine 300-1 for managing the drill bit direction system 100 is shown. This control system moves between two states based upon a determination in state 304 if the drill bit is not in alignment with a desired direction or range of directions. This embodiment corresponds to the embodiment of FIG. 2. Where there is disorientation beyond an acceptable deviation, the drill bit direction system goes from state 304 to state 308. In state 308, one or more of the biasing mechanism and/or steering mechanisms are tried. In some cases, the same biasing and/or stochastic steering mechanism may be tried with different parameters. For example, a gage pad can be moved at one phase in the bit rotation cycle, but later another phase is tried with the same or a different movement of the gage pad.

A number of variations and modifications of the disclosed embodiments can also be used. For example, the invention can be used on drilling boreholes or cores. The control of the biasing process is split between the ICIS and the BHA in the above embodiments. In other embodiments, all of the control can be in either location.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks may be stored in a machine readable medium such as a storage medium. A code segment or machine-executable instruction may represent a procedure, a function, a subprogram, a program, a routine, a subroutine, a module, a software package, a script, a class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

For a firmware and/or software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, wireless channels, and/or various other storage mediums capable of storing that contain or carry instruction(s) and/or data.

While the principles of the disclosure have been described above in connection with specific apparatuses and methods, it is to be clearly understood that this description is made only by way of example and not as limitation on the scope of the disclosure.

What is claimed is:

1. A method for controlling a directional drilling system, the directional drilling system comprising a bottomhole assembly including a drill bit for drilling a borehole, to directionally drill the borehole through an earth formation, comprising:

rotating the drill bit in the borehole;

applying a side force to the drill bit;

steering the directional drilling system, wherein the step of steering the directional drilling system comprises using a geostationary, non-concentrically coupled gauge pad assembly to control stochastic motion of the bottomhole assembly and-bias the side force being applied to the drill bit, wherein the gauge pad system is held geostationary and does not rotate with the drill bit;

determining a direction of drilling of the borehole by the steered directional drilling system;

processing directional drilling data, wherein the directional drilling data comprises the determined direction, properties of the side force being applied to the bottomhole assembly and a desired endpoint for the borehole; and adjusting the steering of the directional drilling system in response to the processed directional drilling data, wherein adjusting of the steering of the directional drilling system comprises using an actuator to adjust the gauge pad assembly and change a direction of the bias of the side force.

2. The method as recited in claim 1, wherein the drill bit is configured to generate a rotating side force along some fixed direction relative to the drill bit during the drilling process.

3. The method as recited in claim 1, further comprising:

using at least one of a point-the-bit system and a push-the-bit system to generate the side force acting on the drill bit.

4. The method as recited in claim 1, further comprising a step of communicating the desired endpoint from above ground.

5. A machine-readable medium having non-transient machine-executable instructions configured to perform the machine-implementable method for controlling the directional drilling system to directionally drill the borehole through an earth formation as recited in claim 1.

6. A drill bit direction system for biasing erratic motion of a drill bit to directionally cause a drill bit to drill in a predetermined direction relative to the earth, the drill bit direction system comprising:

a side force generator configured to generate a side force to act on the drill bit;

a biasing mechanism to emphasize components of radial motion of the drill bit in the predetermined direction of the drill bit relative to the earth, wherein the biasing mechanism comprises a gauge pad system that is eccentrically coupled with the drill bit and is configured in use to not rotate in the borehole when the drill bit is being rotated during a drilling procedure;

a direction sensor to determine a direction of the drill bit downhole;

a controller for comparing a predetermined direction with the direction; and an actuator configured in use to adjust the eccentricity of the biasing mechanism to emphasize components of the radial motion to change the direction of the drill bit to the predetermined direction.

7. The drill bit direction system for biasing erratic motion of the drill bit to directionally cause the drill bit to drill in the predetermined direction relative to the earth as recited in claim 6, wherein:

the side force generator comprise a drill bit manufactured to exert a rotating side force along some fixed direction relative to the drill bit, and the biasing mechanism is configured to bias the rotating side force, whereby the drill bit tends to turn toward the predetermined direction.

8. The drill bit direction system for biasing erratic motion of the drill bit to directionally cause the drill bit to drill in the predetermined direction relative to the earth as recited in claim 6, wherein:

the drill bit is manufactured to exert a rotating side force along some fixed direction relative to the drill bit.

9. The drill bit direction system for biasing erratic motion of the drill bit to directionally cause the drill bit to drill in the predetermined direction relative to the earth as recited in claim 6, wherein the controller is located downhole.

10. The drill bit direction system for biasing erratic motion of the drill bit to directionally cause the drill bit to drill in the predetermined direction relative to the earth as recited in claim 6, wherein the predetermined direction is determined on a surface and communicated to the bottom hole assembly.

11. A method for controlling a directional drilling system, the directional drilling system comprising a bottomhole assembly including a drill bit for drilling a borehole, to directionally drill the borehole through an earth formation, comprising:

using the directional drilling system to drill the earth formation, wherein drilling the earth formation comprises rotating the drill bit in the borehole;

applying a side force to the drilling system;

determining directional drilling data for the directional drilling system, wherein the directional drilling data comprises at least one of location of the bottomhole assembly in the earth formation and a direction of drilling of the directional drilling system through the earth formation;

processing the drilling data, properties of the side force being applied to the drilling system and a desired drilling objective to determine a desired drilling direction; and controlling stochastic motion of the bottomhole assembly to steer the directional drilling system to drill the borehole in the desired drilling direction, wherein the step of controlling the stochastic motion comprises using a gauge pad system that is eccentrically coupled with the drill bit and configured to remain geostationary on the drilling system to control stochastic interactions between the eccentrically coupled gauge pad system and an inner-wall of the borehole, and wherein the controlling stochastic motion of the bottomhole assembly to steer the directional drilling system comprises adjusting the eccentricity of the gauge pad system to change the stochastic interactions between the eccentrically coupled gauge pad system and the inner-wall of the borehole.

12. The method according to claim 11, wherein the desired drilling objective comprises a desired endpoint for the borehole.

13. The method according to claim 12, further comprising: adjusting the desired endpoint during the drilling process.

14. The method according to claim 13, wherein the desired endpoint is adjusted in response to measurements made in the borehole during the drilling process.

15. The method according to claim 13, wherein the drilling trajectory is adjusted in response to measurements made in the borehole during the drilling process.

16. The method according to claim 11, wherein the desired drilling objective comprises a drilling trajectory.

17. The method according to claim 16, further comprising: adjusting the drilling trajectory during the drilling process.

18. The method according to claim 11, wherein the drilling trajectory is determined prior to the drilling procedure.

* * * * *

UNITED STATES PATENT AND TRADEMARK OFFICE

CERTIFICATE OF CORRECTION

PATENT NO. : 8,720,604 B2
APPLICATION NO. : 12/116444
DATED : May 13, 2014
INVENTOR(S) : Michael Charles Sheppard, Ashley Bernard Johnson and Geoffrey Downton It is certified that error appears in the above-identified patent and that said Letters Patent is hereby corrected as shown below:

Title page, item 75

The inventorship should read as follows:

MICHAEL CHARLES SHEPPARD
ASHLEY BERNARD JOHNSON
GEOFFREY DOWNTON

Signed and Sealed this
Fifth Day of January, 2016

Michelle K. Lee

Michelle K. Lee
*Director of the United States Patent and Trademark Office*